US007069602B1

(12) United States Patent
Conway et al.

(10) Patent No.: US 7,069,602 B1
(45) Date of Patent: Jul. 4, 2006

(54) DISPENSER MOUNTABLE UNDER A TOILET BOWL RIM

(75) Inventors: Simon M. Conway, Burlington, WI (US); Stephen R. Schwallie, Racine, WI (US); Terry M. Kovara, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 11/011,577

(22) Filed: Dec. 14, 2004

(51) Int. Cl.
*E03D 9/02* (2006.01)

(52) U.S. Cl. ..... 4/231

(58) Field of Classification Search ..... 4/231, 4/223, 224, 459, 232, 222; 222/156, 157
See application file for complete search history.

(56) References Cited

U.S. PATENT DOCUMENTS 1,202,822 A 10/1916 Ferriss
1,359,535 A 11/1920 Runser
1,815,197 A 7/1931 Gamel et al.
1,974,955 A 9/1934 Foltis
1,979,755 A 11/1934 McDermott
2,214,798 A 9/1940 Reikosky
3,736,600 A 6/1973 Drinkwater
3,946,448 A 3/1976 Sioufy
6,178,564 B1 1/2001 Leonard et al.
6,311,340 B1 11/2001 Thompson
6,412,120 B1 7/2002 Leonard et al.
6,817,040 B1 11/2004 Klinkhammer et al.
6,854,136 B1 * 2/2005 Leonard et al. ..... 4/231

* cited by examiner

*Primary Examiner*—Khoa D. Huynh

(57) ABSTRACT

Devices for dispensing cleaning chemicals from under the rim of a toilet bowl are suspended from either an open bottom toilet bowl rim or a toilet bowl rim with bottom wall holes, using a brush or brush-like suspender. Bristles of the brush flex together to permit the brush to extend into toilet bowl rim holes or an entrance of an open bottom rim. They then expand away from each other to retain the dispenser directly under the rim, in an essentially hidden manner.

3 Claims, 3 Drawing Sheets

DISPENSER MOUNTABLE UNDER A TOILET BOWL RIM

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to dispensers, and in particular to dispensers for dispensing cleaning and/or freshening chemicals into toilet bowl water from a dispenser mounted adjacent the rim of a toilet bowl.

Toilet bowls require care to prevent the buildup of unsightly deposits, to reduce odors and to prevent bacteria growth. Traditionally, toilet bowls have been cleaned, deodorized and/or disinfected by manual scrubbing with a liquid or powdered cleaning/sanitizing agent that is added to the bowl water by hand. This task has required manual labor to keep the toilet bowl clean.

In order to reduce or in some cases eliminate the need for such manual scrubbing, various automatic toilet bowl cleaning systems have been proposed. One type of system delivers the cleaning chemical by adding it to the flush water while the flush water is still stored in the toilet tank. Some embodiments of this type of system add the chemical in sequence to the flushing cycle in liquid form. Others place a block of cleaning chemical in the toilet tank, to slowly dissolve over several weeks or longer.

However, a system which relies on adding the chemical to the storage tank typically requires the consumer to lift a tank lid in order to install the device and/or to add a new charge/block of cleaning chemical. Also, for some of the embodiments of this system precise control over the quantity of chemical to be delivered is difficult, with resulting waste of cleaning chemical or inadequate cleaning. Further, when the chemical is placed in the storage tank the cleaning chemical must be compatible for long-term contact with some of the valving present in the toilet tank, which may impose some limitations on formulation.

An alternative type of system hangs a dispenser adjacent and/or immediately under the toilet bowl rim. Water flowing from the rim will wash over the dispenser, thereby triggering dispensing of the stored chemical directly into the bowl water. Examples of this type of system include U.S. Pat. Nos. 6,178,564, 6,311,340 and 6,412,120.

While this latter type of system is becoming increasingly popular, there are some disadvantages associated with current products that embody this approach. One disadvantage is that some of these devices use a hook that extends over the top (and usually to some extent an outside side wall) of the toilet bowl rim to mount the device. While the toilet seat will hide this when the seat is down, when the toilet seat is picked up (e.g. for a male to urinate), the device will be visible.

In any event, the presence of the device must be taken into account when cleaning the upper area of the toilet bowl rim. For example, one might need to slide or remove the device during cleaning.

Further complicating matters is that the designs of toilet bowl rims vary widely between manufacturers, and even between different models of a single manufacturer. Apart from differences in width and height, some toilet bowl rims are essentially completely open at the bottom. See e.g. U.S. Pat. No. 3,946,448. Others are largely closed at the bottom to form a box-like cross section conduit, with the bottom of the box having a series of relatively small drain holes. See e.g. U.S. Pat. Nos. 1,359,735 and 1,815,197.

Some holders that are suitable to mount a dispenser under the rim by a prong that is extendable into a small rim drain hole (see e.g. U.S. Pat. Nos. 1,202,822, 1,974,955, 1,979,755, 2,214,798, and 3,736,600) are generally unsuitable for mounting that same device under an open bottom rim like that of U.S. Pat. No. 3,946,448. Hence, such a product would typically be sold with a label that advises consumers to check the type of toilet rim they have before buying. Since many consumers aren't readily aware of that information, that creates a marketing impediment which may lead a consumer to select a system that provides the chemical to the tank directly (rather than mounts under the bowl rim).

In U.S. patent application Ser. No. 10/435,359, filed May 9, 2003, our company described mounting a toilet bowl cleaner dispenser directly under an open bottom style rim, without the need for a hook that extends over the top of the rim and along the outside of the rim. Our company described that a vertical support could instead extend up from the dispenser directly into the lower side of the rim, the support being connected to a resilient arm that extended sideways and downward across the rim interior, at an angle. The flexibility of the arm adjusted for open bottom rims of varying widths. Frictional contact between the arm and the rim interior held the dispenser in place.

That application also disclosed that by making the flexible arm sufficiently flexible and small it could be pressed against the support so that both could pass together part way into holes in toilets having rims with bottom walls having such holes. However, if the rim was dimensioned too tall, such an arm could pass all the way into the rim and catch in place inside the rim, making removal difficult. If instead the rim hole was too small, the arm plus support might not fit into it at all. Finally, even if the device was properly sized for the rim, the plastic had to be specially shaped to prevent the device from too easily being pulled out from the rim.

Hence, a need still existed for improved under-the-rim type toilet bowl cleaner dispensers, particularly those that can be mounted into a variety of toilet bowl rims, yet do so in a manner in which the dispenser is largely or entirely hidden from the consumer during use.

BRIEF SUMMARY OF THE INVENTION

In one aspect the invention provides a dispensing device for using a flow of water during a toilet flush to dispense a chemical into a toilet bowl. The device has a housing for holding the chemical, the housing having an opening. The device also has a suspender for suspending the housing from a rim of the toilet bowl. The suspender is a brush having flexible bristles adjacent its upper end and having a lower support end. The lower support end is linked to the housing.

The most preferred form of brush has fifty or more thin bristles (e.g. like a bottle or test tube brush). However, the number of bristles can be reduced as the thickness of the bristles increases, without compromising supporting capability. Also, the number of bristles can be reduced for any given thickness depending on the selection of the material used for bristle formation.

In any event, the term "brush" is intended to include any structure with a support from which extends at least three resilient or flexible arms or bristles in a somewhat radial or transverse direction.

The housing used with such a dispensing device is configured such that if the device is mounted to the toilet bowl rim by contact between the brush and the rim, water that has flowed through the rim can cause a portion of the chemical to be dispensed into water in the bowl. The chemical in the housing can be one or more liquids, or may be a mixed formulation solid, or may be partially a liquid and partially a solid. When the chemical is a solid, the solid can be in the form of a dissolvable block stored in a dispensing cage. When the chemical is a liquid, the housing may be an inverted bottle that feeds a dispensing tray.

While the specific cleaning chemical used is not critical to the present invention, one liquid formulation suitable for toilet bowl cleaning is described in U.S. Pat. No. 6,425,406. Like that formulation, preferred toilet bowl cleaners for use with the present invention will include at least one surfactant.

In any event, in this embodiment, the supporting device is in the form of a brush. The brush desirably is positioned adjacent the upper end of the device, and has a portion which is wide enough and with suitable flexibility so as to cause a jam fitting in conventional open bottom rims, while permitting the brush top end to collapse to pass through relatively small rim bottom holes.

Conventional test tube brushes (apart from their handle end) have about the right dimensions and flexibility for use in supporting the housings of the present invention. In one form a central supporting core of the brush is made of a twisted corrosion-resistant metal such as stainless steel. Bristles made of a synthetic material (e.g. nylon, polyester, or polyethylene) are mounted in the twisted core support in a conventional manner. Numerous companies produce brushes of this type for test tube or other cleaning purposes. For example, some brushes of this type are available from Brushes Corp. of Cleveland, Ohio.

In another aspect the invention provides a variant dispensing device for using a flow of water during a toilet flush to dispense a chemical into a toilet bowl. This device also has such a housing and has a suspender for suspending the housing from a rim of the toilet bowl.

However, here the suspender has a support 16 having a longitudinal axis, and a resilient arm adjacent an upper end of the support and extending transversely there from. The arm could be a conventional brush bristle, or alternatively a thickened plastic arm. In any event, here the resilient arm is designed to be capable of bending relative to the longitudinal axis through an arc of greater than 90 degrees without modifying the rest position (e.g. FIG. 1) of the arm (compare FIG. 4).

Thus, the arm can bend down towards the support when the arm is pushed through a small rim hole. Further, after it passes through the rim hole it can flex outward. Moreover, when it is desired to remove the suspender from a rim, the arm can then bend upwardly sufficiently so that the arm moves out of the way to permit the removal. Hence, the arm will not permanently catch in rims of the type having small rim holes, while the arm still permits mounting in a way that is adequately supportive while the device is installed.

In other aspects the invention provides toilets in which these dispensing devices are installed. When the toilet has an essentially open bottom rim, a chemical dispensing device of the above kind can be mounted in the rim by jamming an upper brush portion of the device between opposed side walls of the rim such that contact (e.g. frictional) between the downwardly angled brush bristles and the side walls retains the chemical dispensing device under the rim.

When the toilet has a substantially closed bottom rim (albeit with a series of bottom drainage holes), the chemical dispensing device can be mounted through one of such holes so that a brush portion of the device is inside the rim and bristles of the rim retain the chemical dispensing device under the rim.

In either case, with appropriate sizing of the housing, the housing can be essentially hidden from view after installation. Further, the top and inside exposed wall of the rim is completely unaffected by the connection, and thus capable of being cleaned without disturbing the device.

As such, one advantage of the present invention to provide an improved toilet bowl chemical dispenser that can dispense quantities of cleaning/freshening toilet bowl treatment chemicals from under the rim of a toilet bowl during a flush, without requiring any attachment connectors that extend over the top of the bowl rim.

It is another advantage of the present invention to provide an under the toilet rim cleansing/freshening device that can be installed under the rim of the toilet bowl in a way that the suspension system and the device itself are normally substantially hidden from view.

It is yet another, particularly desirable, advantage of the present invention to provide an under the toilet rim cleansing/freshening device where the device can be used with a variety of toilet bowl rim sizes and types.

It is still another advantage of the present invention to provide a suspender for such a device that renders the system suitable for use with dispensing housings that can store liquid, solid and/or both cleaning chemicals.

The foregoing and other advantages of various embodiments of the invention will be apparent from the following description. In that description reference will be made to the accompanying drawings which form a part thereof, and in which there is shown by way of illustration preferred embodiments of the invention.

DETAILED DESCRIPTION OF THE PREFERRED EMBODIMENT

Figure 1:
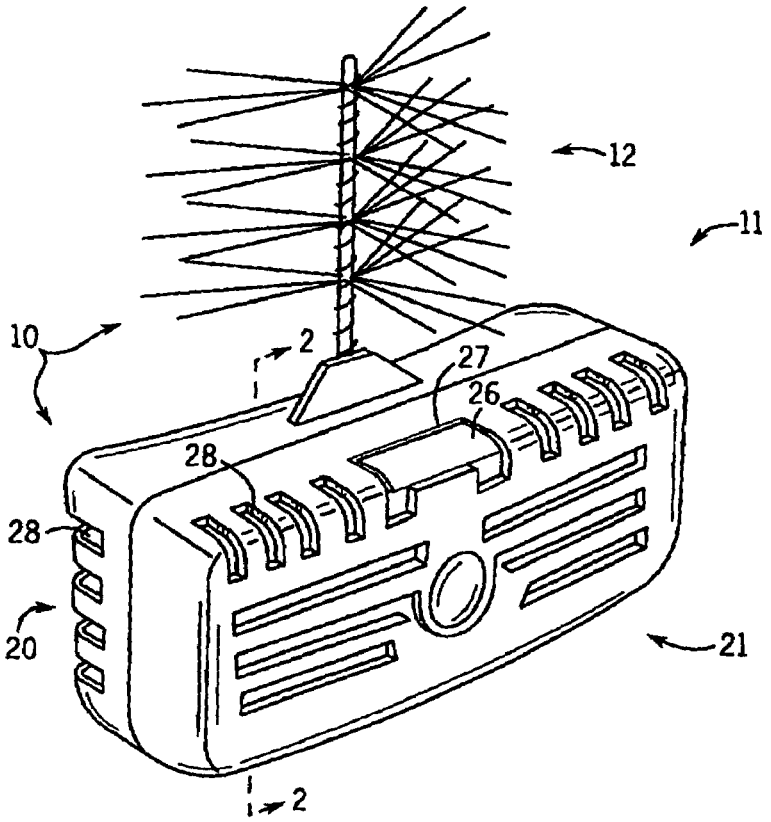
FIG. 1 is a left upper, frontal, perspective view of a first embodiment of a dispensing device of the present invention, the device being suitable to store a solid block of chemical.
Figure 2:
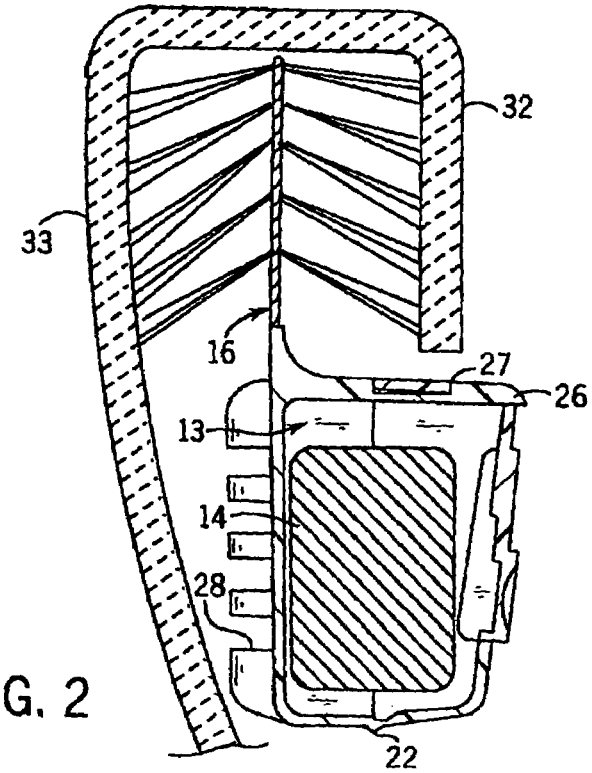
FIG. 2 is a cross sectional view taken along line 2—2 of FIG. 1, albeit with the device mounted in a toilet bowl rim of the open bottom type.

Turning first to FIGS. 1 and 2, there is a dispenser (generally 10) having a housing/cage portion (generally 11) supportable by a brush form suspender (generally 12). The interior 13 of the housing 11 constitutes a cage for retaining a dissolvable block 14 of cleaning material.

The brush 12 preferably has a twisted wire central core 16 from which extends a plurality of flexible bristles. The twisted wire core 16 is preferably made of a metal or plastic, and the bristles are preferably made of plastic.

The bristles can be integral with the core 16, or can be attached to the core by a conventional brush formation technique (e.g. winding the bristles with a wire core; adhering the bristles by adhesive; etc.).

The bottom of the wire core 16 may be connected to the housing 11 by any suitable technique. It may be integrally formed with the housing 11. However it is preferred (for ease of molding) to form the brush separately and attach it by a technique such as winding, melt bonding, adhesive; etc. For example, the lower end of the wire core can be wound around a receiving projection (not shown) formed on the housing 11.

In the FIG. 1 embodiment the housing 11 is in the form of a hangable clam shell type cage made by molding a thermoplastic. There is a first housing half 20 linked to a second housing half 21 by a living hinge 22. The housing halves 20 and 21 include a latch which is a projection 26 interfitting with a retaining aperture 27.

When the first and second housing halves 21/22 are brought together after the block 14 has been inserted there between, the projection 26 pops up into aperture 27 in housing half 21. In order to open the housing 11, it is necessary to manually depress the projection 26 so that it is released from aperture 27, followed by relative pivoting of the housing halves.

The walls of the housing 11 contain openings 28 which permit liquid falling from the rim to pass into the cage cavity 13, against the block 14, and then out the housing 11. When this embodiment is used, a rim block/tablet 14 is chosen so that it slowly dilutes into the water.

Various other structures may be associated with this type of cage such as described in U.S. Pat. No. 6,311,340. However, the specifics of the cage are not critical as long as the cage permits the chemical to be dispensed into the bowl water by virtue of the rim water.

A particularly important feature is the suspender brush 12 and how it interacts with toilet bowl rims. As best seen in FIG. 2, when the rim is of the essentially bottomless type, the brush diameter (at rest) is chosen to be somewhat wider than the narrow point of the rim between rim side walls 32 and 33. The jamming of the brush bristles against the somewhat roughened ceramic rim interior causes the brush bristles to resist downward movement of the device sufficiently that the brush acts to retain the device.

If one views that rim from directly above (as a consumer might typically do), the brush 12 is completely hidden, and the dispensing device 10 is essentially completely hidden. Moreover, with a slight yanking force applied by a consumer the device can easily be completely removed from the rim if desired (e.g. for replacement of the device or maintenance of the rim). This is because the bristles will flex from the FIG. 2 position to a position where the bristles are angled upwardly under exposure to such a removal force.

The FIG. 2 dispenser can be designed for long-term use because one can leave the device in the rim while still accessing it to insert a new rim block 14. However, some consumers may prefer to make such an insertion of a new chemical block while not leaning over the toilet bowl. In such a case, a consumer could remove the device, install the new block of chemical, and then re-install the device. This is facilitated because the brush rest position is not distorted by the bending motion inherent in the installation or removal.

Figure 3:
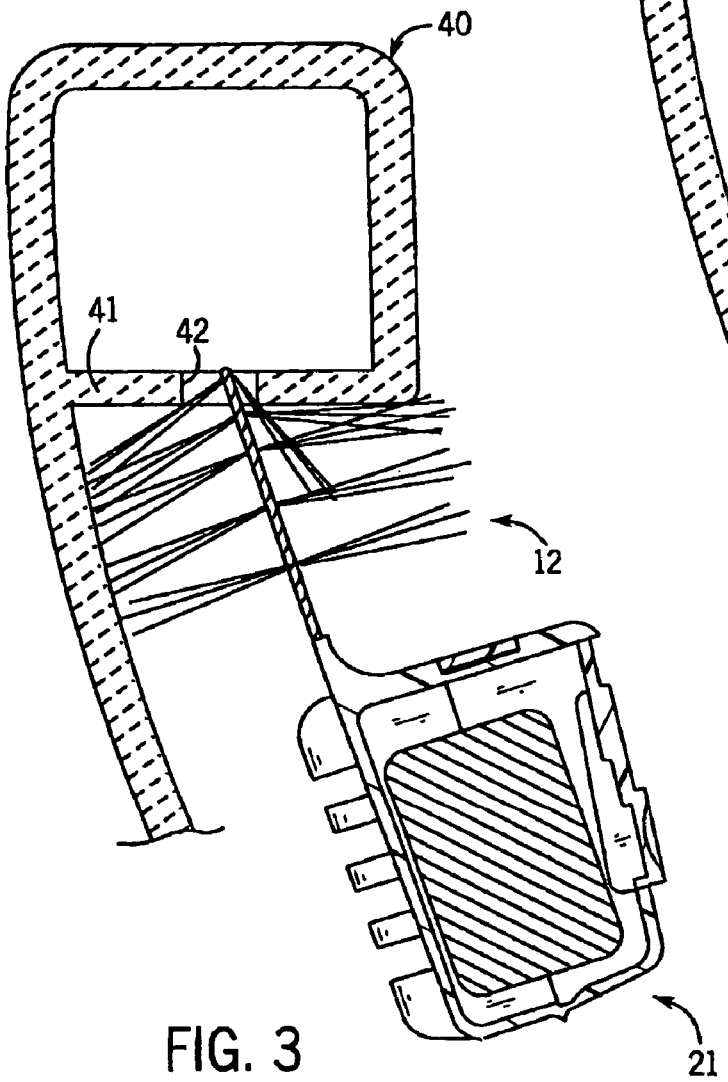
FIG. 3 is a view similar to FIG. 2, but showing the device in the process of being mounted in a different type of toilet bowl rim, one having a closed bottom with small drain holes.
Figure 4:
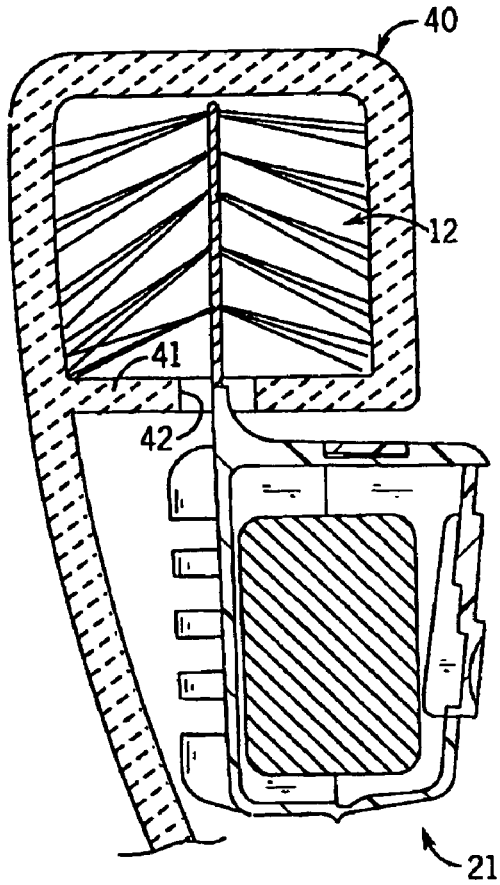
FIG. 4 is a view similar to FIG. 3, but showing the device fully mounted in the FIG. 3 toilet bowl rim.

Turning next to FIGS. 3 and 4, it will be appreciated that the device can be suspended from an alternative rim 40 that has a portion with an essentially closed bottom wall 41 except for a series of relatively small drainage holes 42. In such a case, the brush can be pushed through one such hole 42. At that point, the bristles compress towards the support core 16, permitting at least some of the bristles to begin to pass through the hole 42 (see FIG. 3).

The bristles then flex outward so as to catch the brush top end inside the rim and thereby hang the dispensing device. See FIG. 4. The brush end 12 is then not visible to the consumer, and the dispenser can be configured and sized so as to also be essentially not visible at that point. Of course, with a moderate yank downward the brush can still be pulled back out the holes for the purposes noted above, again, because the bristles will swing upward through an arc exceeding 90 degrees as the dispenser is being yanked downward from the FIG. 4 position.

Figure 5:
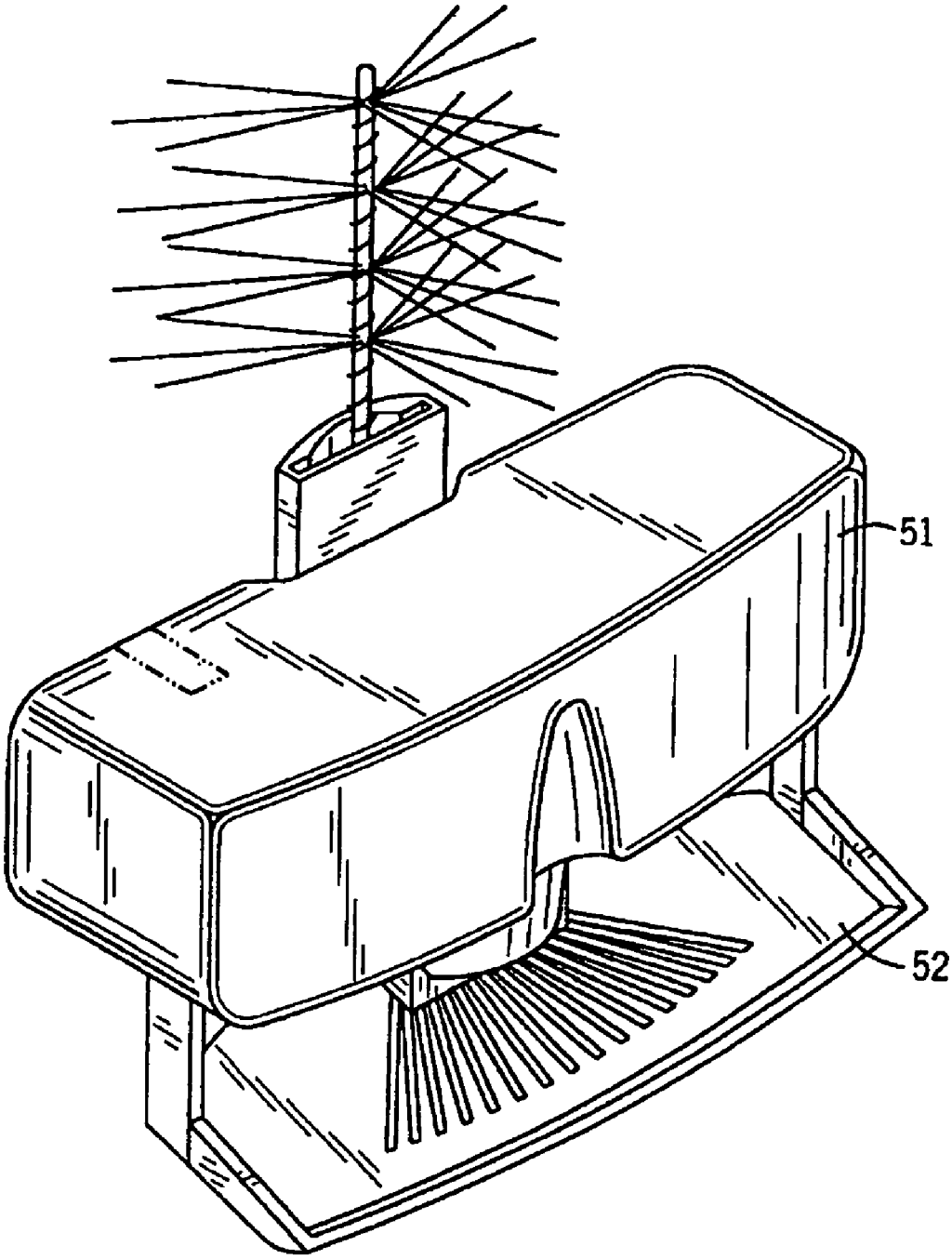
FIG. 5 is a left upper, frontal, perspective view of a second embodiment of the present invention, where a liquid reservoir is supported by a brush.

Turning next to FIG. 5, there is shown an alternative embodiment of the lower portion of the device, one where the cleaning chemical is stored as a liquid. As will be appreciated from U.S. Pat. Nos. 6,178,564 and 6,412,120, devices of this type store one or more cleaning liquids in an inverted reservoir/housing 51. The reservoir bleeds cleaning fluid via gravity onto a capillary tray 52, and the water falling from the rim washes the concentrated liquid off the tray and into the bowl.

Such a device can now be supported by a brush type suspender, similar to that described in connection with the FIG. 1 embodiment. Thus, it should be appreciated that the present brush support system can be used with a variety of housings, and regardless of whether those housings store the cleaning/freshening chemical as a solid, or as a liquid, or as both.

The above description and the associated drawings merely disclose preferred embodiments of the present invention. Still other modifications may be made without departing from the spirit and scope of the invention. For example, the brush need not have hundreds of bristles. Instead, the brush could have as few as three bristles. A brush with at least ten bristles is most preferred.

Also, the exact height of the brush is not critical. While it is preferred that the brush be at least 1 cm in height (preferably at least 2 cm in height), shorter brushes may also work.

Also, there could be more than one brush. For example, in the case of a liquid dispenser the weight may be such that multiple spaced brush connectors are desirable.

Further, the suspender could be modified from a brush to a core having even a single transverse arm. In such an embodiment the arm should be sufficiently flexible to swing through an arc of more than 90 degrees.

Still other variations on the above structures are possible within the spirit and scope of the invention. Hence, the invention is not to be limited to just the preferred embodiments described above and/or disclosed in the accompanying drawings. Rather, the claims should also be looked to in order to judge the full scope of the invention.

INDUSTRIAL APPLICABILITY

The present invention provides dispensers for dispensing cleaning and/or freshening chemicals from under the rim of a toilet bowl by way of the flow of water during a toilet flush.

We claim:

1. A dispensing device for using a flow of water during a toilet flush to dispense a chemical into a toilet bowl, the device comprising:

a housing for holding a chemical, the housing having an opening; and a suspender for suspending the housing in a rim of the toilet bowl, the suspender comprising a brush having flexible bristles adjacent its upper end and having a lower support end, the lower support end being linked to the housing;

wherein the housing is configured such that if the device is mounted in the toilet bowl rim by contact between the brush and the rim, water flowing through the rim causes a portion of the chemical to be dispensed into water in the bowl;

wherein the bristles are capable of bending through an arc of greater than 90 degrees; and wherein the housing comprises a reservoir holding a liquid cleaning chemical.

2. The dispensing device of claim 1, wherein the bristles are made of a plastic.

3. A dispensing device for using a flow of water during a toilet flush to dispense a chemical into a toilet bowl, the device comprising:

a housing for holding a chemical, the housing having an opening; and a suspender for suspending the housing in a rim of the toilet bowl, the suspender comprising a support extending along a longitudinal axis, and a plurality of resilient arms adjacent an upper end of the support and extending transversely there from;

wherein a lower end of the support is linked to the housing;

wherein the resilient arms are capable of bending relative to the longitudinal axis through an arc of greater than 90 degrees without modifying the rest position of the arms; and wherein the housing is configured such that if the device is mounted in the toilet bowl rim by contact between the arm and the rim, water flowing through the rim causes a portion of the chemical to be dispensed into water in the bowl.

* * * * *